US005474878A

United States Patent [19]

Sakuma

[11] Patent Number: 5,474,878

[45] Date of Patent: Dec. 12, 1995

[54] METHOD FOR PROCESSING A SILVER HALIDE PHOTOGRAPHIC LIGHT-SENSITIVE MATERIAL

[75] Inventor: Haruhiko Sakuma, Hino, Japan

[73] Assignee: Konica Corporation, Japan

[21] Appl. No.: 291,274

[22] Filed: Aug. 16, 1994

[30] Foreign Application Priority Data

Aug. 19, 1993 [JP] Japan ..... 5-205291

[51] Int. Cl.[6] ..... G03C 5/29; G03C 5/38

[52] U.S. Cl. ..... 430/401; 430/400; 430/421; 430/963; 354/319; 354/320; 354/321; 354/322

[58] Field of Search ..... 430/400, 401, 430/421, 963; 354/319, 320, 321, 322

[56] References Cited

U.S. PATENT DOCUMENTS

| | | | |
|---|---|---|---|
| 3,545,971 | 12/1970 | Barnes et al. | 430/963 |
| 4,665,012 | 5/1987 | Sugimoto et al. | 430/567 |
| 4,713,318 | 12/1987 | Sugimoto et al. | 430/567 |
| 4,883,748 | 11/1989 | Hayakawa | 430/568 |
| 4,994,839 | 2/1991 | Yamakoshi | 354/321 |
| 5,081,007 | 1/1992 | Sakuma | 430/963 |

FOREIGN PATENT DOCUMENTS

| | | | |
|---|---|---|---|
| 273411 | 7/1988 | European Pat. Off. . | |
| 1-177542 | 7/1989 | Japan | 430/401 |
| 4-97344 | 3/1992 | Japan | 430/401 |
| 6-102630 | 4/1994 | Japan | 430/401 |

OTHER PUBLICATIONS

Ueda et al., U.S. Statutory Invention Registration H789, Jun. 1990.

*Primary Examiner*—Charles L. Bowers, Jr.
*Assistant Examiner*—J. Pasterczyk
*Attorney, Agent, or Firm*—Jordan B. Bierman; Bierman and Muserlian

[57] ABSTRACT

Disclosed is a method for processing a silver halide photographic light-sensitive material using a roller transport automatic processing machine having a developing tank containing a developing solution, a fixing tank containing a fixing solution, a washing tank containing a washing solution and a drying means, comprising the steps of:

developing the silver halide photographic light-sensitive material, fixing the developed material, washing the fixed material, and drying the washed material, wherein said method is carried out under the following condition:

$$9.0 \leqq H_D^{0.75} \times T \leqq 21.0,\ H_D = H_1 + H_2,\ H_1 \leqq H_2,$$

wherein $H_D$ represents transport line length, in meters, of the material entry point into the developer solution to the material entry point into the washing solution, $H_1$ represents transport line length, in meters, of the material entry point into the developer solution to the material entry point into the fixing solution, $H_2$ represents transport line length, in meters, of the material entry point into the fixing solution to the material entry point into the washing solution, and T represents in terms of seconds time necessary for transporting the material of the material entry point into the developing solution to the material entry point into the washing solution, and said material comprises a silver halide photographic emulsion comprising silver iodobromide or silver chloroiodobromide grains containing a silver iodide content of not more than 1.0 mol %, wherein at least 50% or more of the whole projection area of the silver bromide or the silver chlorobromide grains, have an average grain thickness of not more than 0.40 μm.

17 Claims, 4 Drawing Sheets

METHOD FOR PROCESSING A SILVER HALIDE PHOTOGRAPHIC LIGHT-SENSITIVE MATERIAL

FIELD OF THE INVENTION

The present invention relates to a method for processing a silver halide photographic light-sensitive material, and more particularly to a light-sensitive material processing method in which the developed light-sensitive material, even when super-rapidly processed in a low-replenishment-rate fixing solution, forms little residual color stain and little fog.

BACKGROUND OF THE INVENTION

With the latest advancement of photographic technology there arises a strong demand for improving the silver halide photographic light-sensitive material so as to have a higher sensitivity, a higher-quality-image-forming capability and a shorter-time processability than ever before.

For example, in the recent medical X-ray diagnostic field, the increasing number of diagnoses and the increasing number of films to be radiographed per diagnosis have now prompted a strong demand for developing technology capable of not only rapidly processing a vast number of angiographed films and X-ray films radiographed in operations but also providing high-speed and high-quality X-ray images for use in diagnoses.

To meet the above demand, a light-sensitive material comprising silver halide tabular grains has lately been developed. The tabular grain, since it has a specific surface area large enough to absorb a lot of a spectrally sensitizing dye, has the advantage that it enables the reduction in cross-over rays as well as the sensitivity improvement.

The tabular grain, however, is disadvantageous because of its inferior resistance to pressure. For this reason Japanese Patent Publication Open to Public Inspection (hereinafter abbreviated to JP O.P.I.) No. 99433/1984 proposes to improve the tabular grain's resistance to pressure by having the grain provided thereinside with a high-silver-iodide content phase, and JP O.P.I. No. 14636/1986 discloses a method for improving the pressure resistance by making the iodide content of the central phase higher than that of the peripheral phase of the tabular grain.

However, these methods based on the use of the iodide are certainly recognized effective in improving the grain's resistance to pressure, but, on the other hand, significantly affect the developing or fixing rate of the grain; for example, if the average silver iodide content of the whole grain is raised, there occurs a problem of not only retarding the developing or fixing rate of the grain but also resulting in decline of the grain's solubility in water to thereby cause a residual color stain-increasing trouble due to sensitizing dyes or other dyes.

We, the inventors of the present invention, have earlier disclosed in our U.S. Pat. No. 5,081,007 a method for processing a silver halide photographic light-sensitive material, which specified the silver halide photographic light-sensitive material's overall transport line length (hereinafter merely called 'line length') range from the light-sensitive material's entry into the developer surface in the developing bath up to the outlet of the drying section.

The invention in the above publication specifies that the line length from the developer surface entry point in the developing bath up to the surface of the fixing solution in the fixing bath shall be equal to or longer than the line length from the fixing solution surface entry point up to the surface of the wash water in the washing bath. That is, since the fixing time is equal to or shorter than the developing time in the above method, the method was found disadvantageous in respect that if applied to a rapid processing with a low-replenishment-rate fixing bath, it causes a fixing failure and a residual dye stain trouble.

In the rapid processing of the silver halide photographic light-sensitive material, reduction in the use of replenisher solutions as well as in processing solutions is an important issue.

Namely, in the London Dumping Convention, LDC, adopted in 1972, the framework for sea dumping of wastes was issued, under which appropriate regulations have been taking place to date. The 13th LED Council held in November 1990 adopted a resolution for banning sea dumping of industrial wastes by the end of 1995, whereupon photographic processing chemicals waste fluid is to fall under this category, and therefore it is essential to reduce the using amount of replenisher solutions.

The replenisher solution supplied to an automatic processor is normally comprised of the same components as those of a running developer solution, and replenishment of it is conducted to make up for the loss equivalent to the exhaustion of processing chemicals by oxidation. As for the replenishing procedure, JP O.P.I. No. 126243/1980 describes a method in which replenishment is controlled according to the film width and feeding speed; JP O.P.I. No. 104946/1985 describes a method in which replenishment is controlled according to the film area to be processed; and JP O.P.I. No. 149156/1989 discloses a method in which replenishment is controlled according to the number of pieces processed in succession. However, because the replenishing amount disclosed in these methods is from 500 ml to 150 ml/m$^2$, reducing the replenishing amount is urgently needed from the environment protection point of view.

SUMMARY OF THE INVENTION

It is therefore an object of the invention to provide a method for super-rapidly processing a silver halide photographic light-sensitive material, in which the silver halide photographic light-sensitive material, even when processed in a reduced-replenishment-rate fixing solution, forms little fog and little residual color stain.

The above object of the present invention is accomplished by:

(1) A method for processing a silver halide photographic light-sensitive material using a roller transport automatic processing machine having a developing tank containing a developing solution, a fixing tank containing a fixing solution, a washing tank containing a washing solution and a drying means, comprising the steps of:

developing the silver halide photographic light-sensitive material, fixing the developed material, washing the fixed material, and drying the washed material, wherein said method is carried out under the following condition:

$$9.0 \leqq H_D 0.75 \times T \leqq 21.0,\ H_D = H_1 + H_2,\ H_1 \leqq H_2,$$

wherein $H_D$ represents transport line length, in meters, of the material entry point into the developer solution to the material entry point into the washing solution, $H_1$ represents transport line length, in meters, of the material entry point into the developer solution to the material entry point into the fixing solution, $H_2$ represents transport line length, in meters, of the material entry point into the fixing solution to the material entry point into the washing solution, and T represents in terms of seconds time necessary for transporting the material of the material entry point into the developing solution to the material entry point into the washing solution, and said material comprises a silver halide photographic emulsion comprising silver iodobromide containing an average silver iodide content of not more than 1.0 mol % or silver chloroiodobromide grains containing an average silver iodide content of not more than 1.0 mol %, wherein at least 50% or more of the whole projection area of the silver iodobromide or the silver chloroiodobromide grains, have an average grain thickness of not more than 0.40 μm.

(2) The method for processing a silver halide photographic light-sensitive material according to the above (1), in which the replenishing amount per $m^2$ to the fixer solution in the processing in the above automatic processor is not more than 300 ml.

In the above drawings

Figure 1:
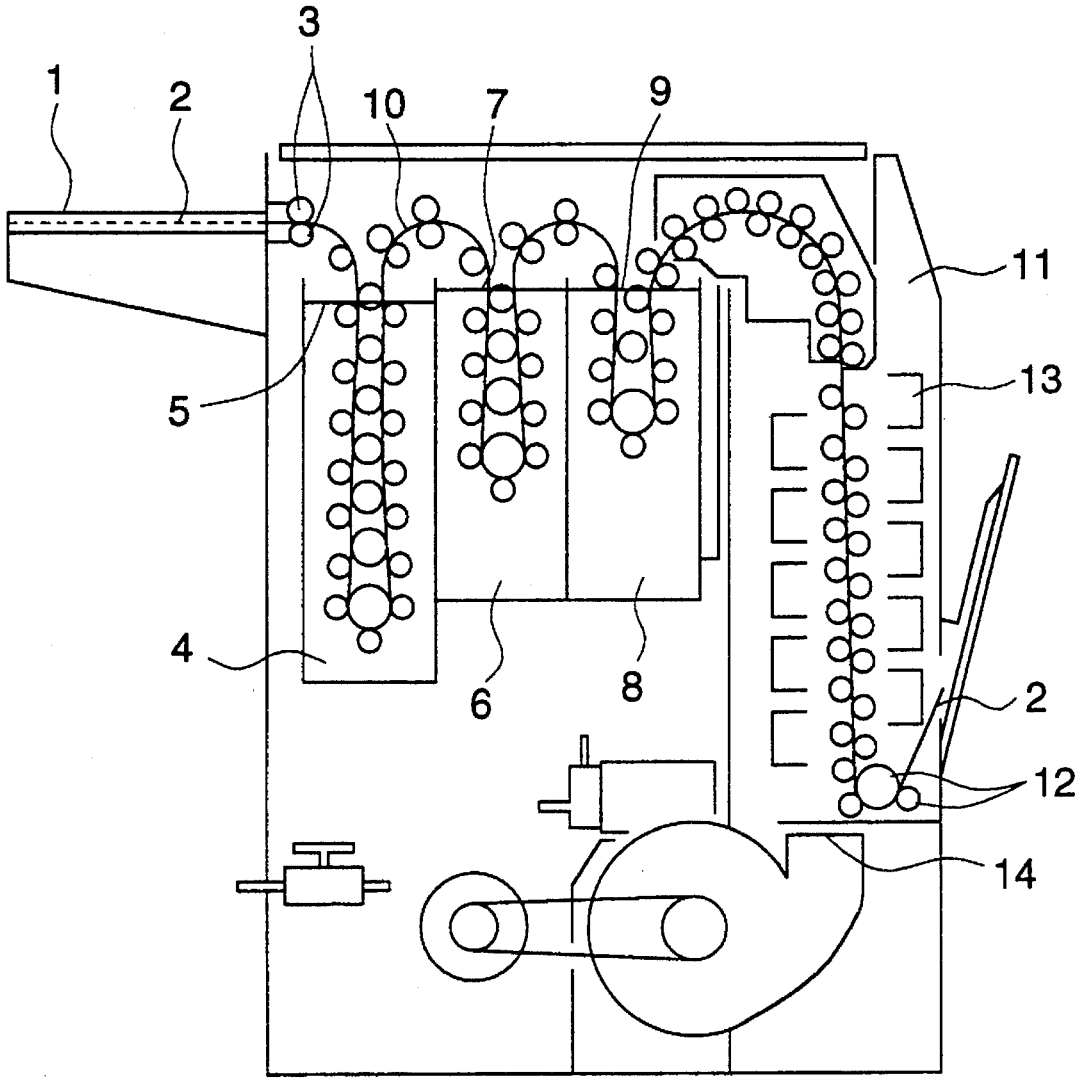
FIG. 1 is a cross-sectional view of a vertical-type automatic processor preferably used for comparison.

1 . . . film feed inlet,

2 . . . film,

3 . . . inlet roller,

4 . . . developing solution tank,

5 . . . level of developing solution,

6 . . . fixing solution tank,

7 . . . level of fixing solution,

8 . . . washing water tank,

9 . . . level of washing water,

10 . . . crossover guide,

11 . . . drying zone,

12 . . . ejection roller,

13 . . . blow-out nozzle, and

14 . . . blower.

DETAILED DESCRIPTION OF THE INVENTION

The processing conditions of the invention is detailed as follows.

$H_D^{0.75} \times T = 9.0$ to 21.0, $H_D = H_1 + H_2$, provided $H_1 \leqq H_2$.

wherein $H_D$ represents transport line length, in meters, of the material entry point into the developer solution to the material entry point into the washing solution, $H_1$ represents transport line length, in meters, of the material entry point into the developer solution to the material entry point into the fixing solution, $H_2$ represents transport line length, in meters, of the material entry point into the fixing solution to the material entry point into the washing solution, and T represents in terms of seconds time necessary for transporting the material of the material entry point into the developer solution to the material entry point into the washing solution, and said material comprising a silver halide photographic emulsion comprising silver halide iodobromide containing an average silver iodide content of not more than 1.0 mol % or silver chloroiodobromide grains containing an average silver iodide content of not more than 1.0 mol %, wherein at least 50% or more of the whole projection area of the silver iodobromide or the silver chloroiodobromide grains, have an average grain thickness of not more than 0.40 μm.

The above $H_1$ and $H_2$ are values found from the criteria established by simulative transport of a long polyethylene terephthalate support of 175 μm in thickness in the same manner as in the practical transport of a silver halide photographic light-sensitive material in processing in order to get rid of an error affected by slip of swollen emulsion or the like.

T represents the time in seconds required for the film to be transported from the entry point on the surface of the developer solution in the automatic processor through the developing bath, crossover guide, fixing bath and crossover guide up to the point where its tip reaches the surface of the wash water in the washing bath.

Why the crossover section is included in the time T is because the processing of the film with its gelatin layers soaked with the processing solution of the preceding process is deemed to be substantially still making progress even when moving through the crossover guide section.

The whole number of transport rollers in the automatic processor of the invention is preferably determined so that the value obtained by dividing the total length in meters of the processor's path length $H_D$ plus the length from the washing bath entry point up to the core of the final roller at the outlet of the drying section by the number of rollers is within the range of 0.01 to 0.04. The percentages of the processing periods of time in the respective processing steps are preferably as follows:

| | |
|---|---|
| Developing + crossover: | 10 to 25% |
| Fixing + crossover: | 25 to 40% |
| Washing + crossover: | 10 to 25% |
| Squeeze + drying: | 25 to 45% |
| Total | 100% |

The roller used is preferably of 12 to 60 mm in diameter and 30 to 110 cm in length, and the rollers used in the developing, fixing, washing and drying sections are preferably made of a bakelite, which may contain glass powder, metallic powder or plastic powder, or of a rubber such as neoprene, isoprene, silicone rubber, etc., while those in the crossover guide and squeezing section are preferably made of a water-repellent elastic silicone rubber or a high-hygroscopic synthetic leather product in trade name 'Kurarino' produced by Kuraray Co., Ltd.

In the line length of the roller-transport-type automatic processor of the invention, where $H_2$ is smaller than $H_1$ in Formula 1, fixing failure is liable to occur, bringing about residual dye stain trouble particularly in the case of a spectrally sensitized silver halide photographic light-sensitive material. When $H_2$ is larger than $H_1$, it causes both sensitivity and contrast to become lowered, and the same tendency appears as well particularly where a silver halide photographic light-sensitive material contains a sensitizing dye in an amount exceeding 7 mg/m$^2$ per side thereof to increase its sensitivity or other dyes in order to cut off crossover rays.

The transport roller may have a rough surface in order to improve its transporting characteristic; for example, the roughness is preferably in the depth range of 0.05 to 1.0 mm. In order to reduce the drying load in the drying section, it is preferable to keep the moisture content of the film until reaching the squeeze rack down to not more than 20 g/m$^2$; this can be carried out by using water-repellent rollers as mentioned above or using high-hygroscopic rollers to the contrary. Designed so as to make drying wind partly blowing toward the squeeze roller is a good method.

In the drying section, the distance between the dry wind blow-off port and the film is preferably in the range of 1 to 10 mm in order to make the heat transmission coefficient as large as possible, the drying wind temperature is preferably 35° to 55° C., and at the same time the drying by means of an infrared heater or microwave heating may be used in combination so that the film can be sufficiently dried even in a rapid processing.

Figure 2:
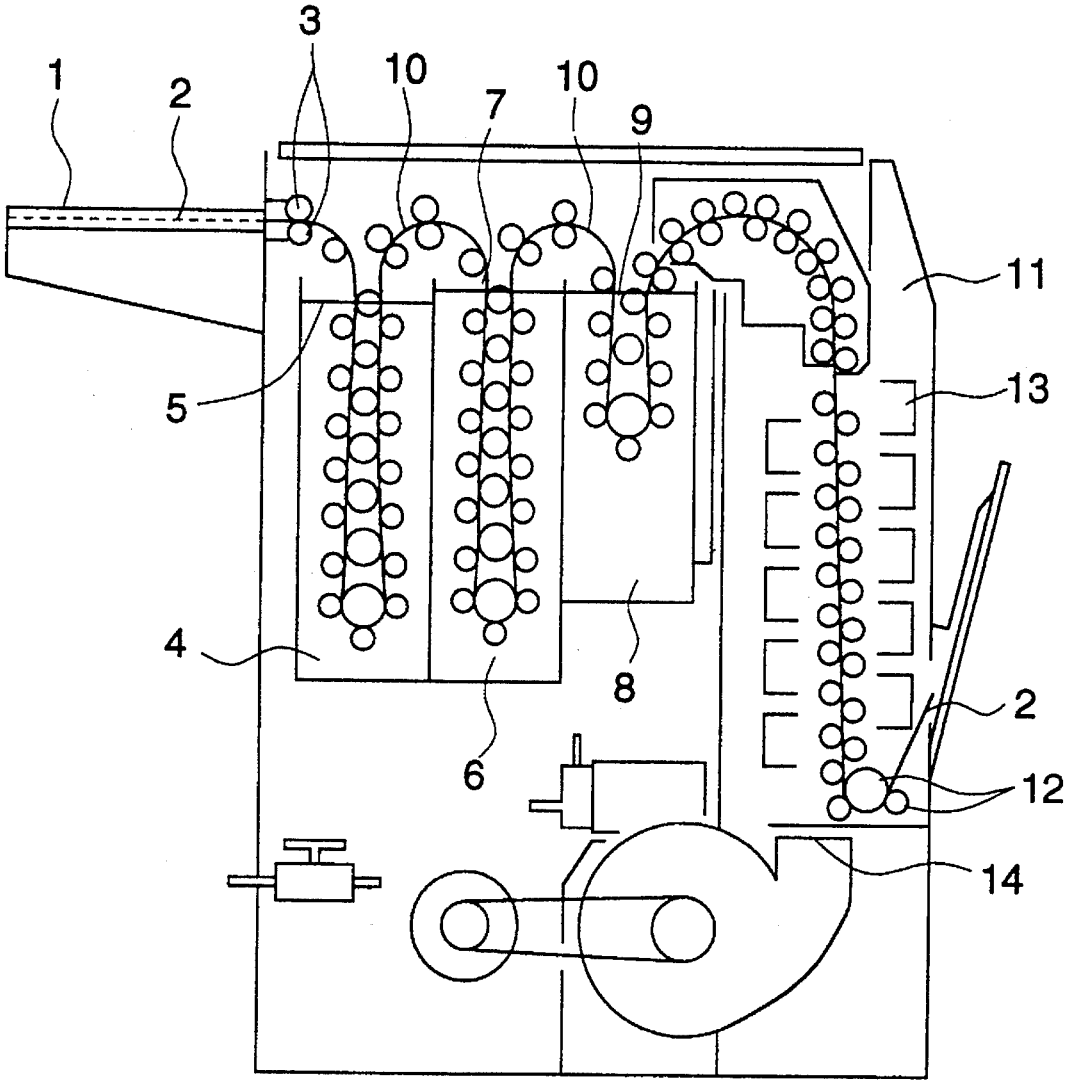
FIG. 2 is a cross-sectional view of a vertical-type automatic processor preferably used in the invention.
Figure 3:
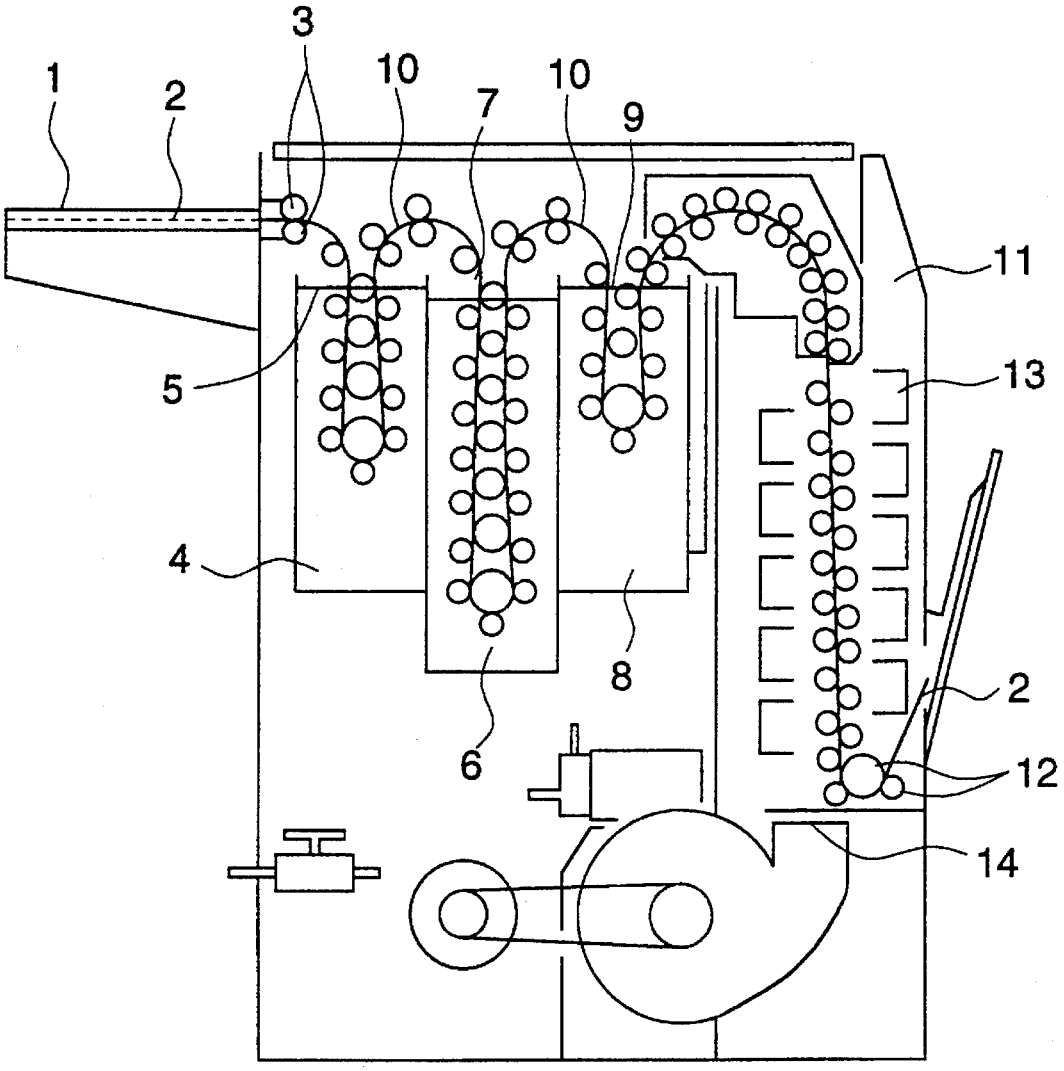
FIG. 3 is a cross-sectional view of a conventional vertical-type automatic processor for the invention.
Figure 4:
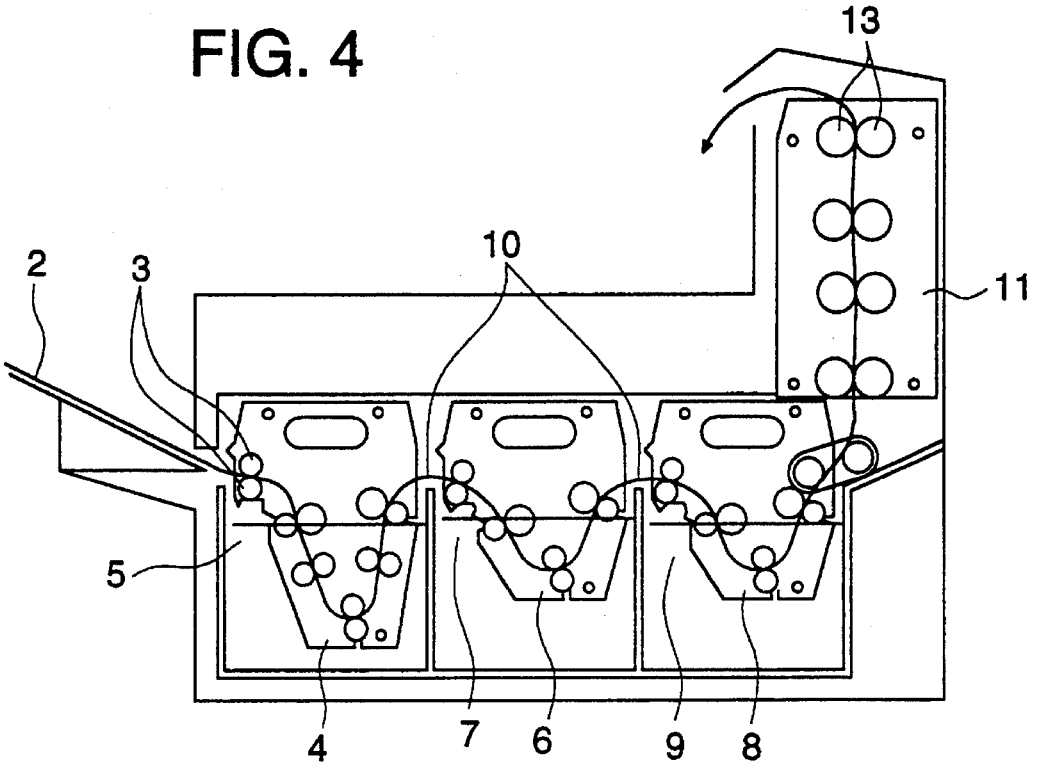
FIG. 4 is a cross-sectional view of a horizontal-type automatic processor for comparison.
Figure 5:
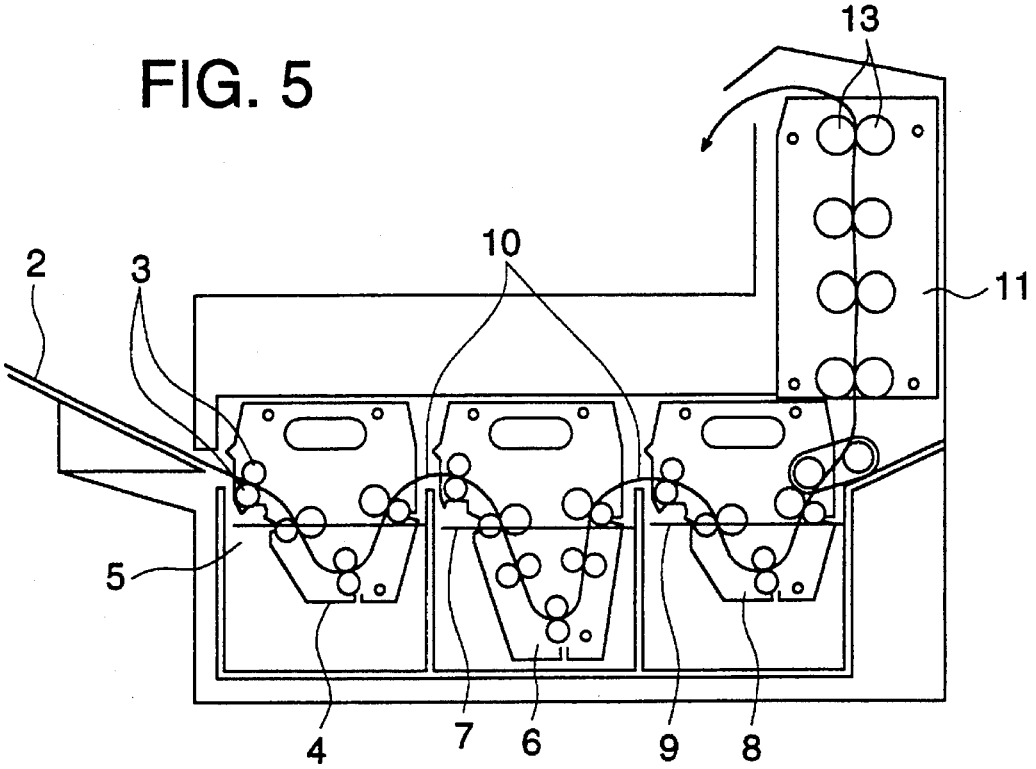
FIG. 5 is a conventional horizontal-type automatic processor for the invention.

The automatic processor shown in the drawings of the invention are cross-sectional views of the automatic processors that are used in the examples of the present invention, wherein FIGS. 1 and 4 show the conventional-type automatic processor for comparison, and FIGS. 2, 3 and 5 are cross-sectional views of the automatic processors suitably usable for the processing of the silver halide photographic light-sensitive material of the invention. In each drawing, if the path length of fixer bath 6 is devised to be equal to or longer than that of developer bath 4, there can be obtained a silver halide photographic light-sensitive material which is free from residual color stain even in the rapid processing intended by the invention.

The silver halide photographic light-sensitive material of the invention is explained. The silver halide photographic light-sensitive material processing method of the invention requires a silver halide photographic light-sensitive material capable of making good developing progress in a super rapid processing in which the developing time is shorter than the fixing time. For this reason, the following silver halide grain is preferred.

The silver halide grain in the invention is preferably a regular crystal grain or tabular twin grain of not more than 0.40 μm in thickness, and more preferably a tabular twin grain in order to not only obtain a high-sensitivity fine grain having an average thickness of not more than 0.40 μm but also to prevent the maximum density drop trouble that tends to occur in the case of rapid processing with use of a fixer bath having little aluminum ions.

The tabular grain includes those grains whose average grain diameter/thickness ratio, a so-called average aspect ratio, is 2 or more, preferably 2.5 to 30, more preferably 3 to 20, and most preferably 4 to 15.

The average thickness of the grain, whether a regular crystal grain or a tabular twin grain, is preferably not more than 0.40 μm, more preferably not more than 0.3 μm, and most preferably 0.05 μm to 0.25 μm.

The silver iodobromide or silver chloroiodobromide grain in the invention has an average silver iodide content of 0 to 1.0 mol %, and preferably 0.1 mol % to 0.8 mol %. The average silver chloride content of the silver chloroiodobromide grain of the invention is 0 to 20 mol %, and preferably 0 to 12 mol %.

The silver halide photographic light-sensitive material of the invention contains silver halide grains, preferably at least not less than 50%, more preferably not less than 70% of the projection area of which consists of silver iodobromide grains having an average silver iodide content of 0 to 1.0 mol % or silver chloroiodobromide grains having an average silver iodide content of 0 to 1.0 mol % and an average silver chloride content of 0 to 20 mol %. Further, in the silver iodobromide or silver chloroiodobromide grains pertaining to the invention, 50% or more of the projection area thereof is preferably occupied by hexagonal tabular silver halide grains each having a maximum length side/minimum length side ratio of not more than 2.0. The silver halide grains for the silver halide emulsion of the invention are hexagonal tabular silver halide grains each having two parallel external surfaces, and preferably monodisperse grains. The internal silver halide composition of the silver halide grain may be not uniform and each grain may contain in the inner side beyond ½ of the volume thereof silver iodide from the solid solution limit to more than 0 mol % and silver chloride of 0 to 30 mol %, and may have in the outer side than ½ of the volume thereof a stratified structure comprising a silver iodide phase from the solid solution limit to more than 0 mol % and a silver chloride phase of 0 to 30 mol %.

The diameter of the projection image of the tabular silver halide grain in the silver halide emulsion of the invention is in the range of preferably 0.2 μm to 2.0 μm, more preferably 0.3 μm to 1.5 μm. The aspect ratio of the tabular grain is preferably not less than 2. It is because if the ratio is 1.8 or less, the maximum density drop is as much conspicuous as in regular, spherical twin crystal grains when processed in a fixer solution containing little aluminum ions, and the silver image tone's deterioration with time is significant and not improved even when pH of the fixer solution is raised to 5.0 or higher.

In the invention, the emulsion, when comprised principally of hexagonal tabular silver halide grains, needs to have an average silver iodide content of not more than 1.0 mol % from the rapid processing and fixability point of view.

The light-sensitive material of the invention, in order to make its photographic performance sufficient for conventional medical autoprocessor systems, requires the average silver chloride content of it not to exceed 20 mol %. If the content exceeds 20 mol %, then it causes an increase in fog or amplifies the inter-processing-system variation in the photographic performance characteristics.

To obtain the improving effect of the invention in getting rid of residual color stain trouble it is important to get silver halide grains corresponding to the invention to account for 50% or more, preferably 70% or more of the projection image of the whole silver halide grains.

The photographic light-sensitive material of the invention may use those silver halide grains having the internal silver iodide distribution varied as disclosed in JP O.P.I. Nos. 99433/1984, 147727/1985, 92942/1988, 152446/1989, 12142/1990, 28638/1990 and 107442/1992. And the light-sensitive material may also use those monodisperse silver halide grains as disclosed in JP O.P.I. Nos. 151618/1988, 213639/1989 and 163433/1991.

The silver halide grain contained in the photographic light-sensitive material of the invention may be one in which its development starting points are concentrated upon a specific part thereof as described in JP O.P.I. No. 305343/1988; one obtained by providing a transition line to the grain described in JP O.P.I. Nos. 220238/1988, 201649/1989 and 175440/1991; or one having the stratified structure described in JP. O.P.I. Nos. 279237/1989 and 273039/1989.

The tabular grain according to the invention, as long as its aspect ratio is not more than 10 as described in JP O.P.I. No.

163451/1988, is preferably a grain having a (b)/(a) ratio of equal to or larger than 5, wherein (a) represents the inter-twin-plane interval measured in the normal manner and (b) represents the grain thickness.

The grain thickness in the invention implies the distance between a pair of principal planes facing each other of the tabular grain; i.e., the shortest length of lines passing through the centroid of the grain between both planes. The thickness of the grain can be obtained by a electron-microscopically observing aslant a sample thereof. The average thickness of the grain is found on the basis of the proportion of the number of grains corresponding to the invention to the whole number of the overall grains of the emulsion containing the grains corresponding to the invention.

The silver halide photographic light-sensitive material in the invention, in the case where the above average grain thickness is not more than 0.40 μm, preferably not more than 0.38 μm, can attain effectively the object of the invention.

The grains used for the silver halide photographic light-sensitive material of the invention are preferably monodisperse grains. The monodisperse emulsion is a silver halide emulsion in which its grain diameter distribution broadness value is less than 30%, preferably less than 20%, wherein the grain diameter distribution broadness (%) is defined by $$\frac{\text{Standard deviation of grain diameters}}{\text{Average grain diameter}} \times 100$$

In the above, the measurement of the grain diameter complies with the previously mentioned method, and the average grain diameter is a simple mean value.

Average grain diameter=$\Sigma dini/\Sigma ni$ wherein dini represents the number ni of diameters di.

The tabular grains emulsion of the invention can be prepared according to any known method. For example, where an aqueous silver nitrate solution and an aqueous halide solution are simultaneously mixed according to a double-jet precipitation process into a seed grains-containing gelatin aqueous solution, discretionary pAg control and variations of the amount of seed grains and of halide composition can be carried out, whereby the grain diameter, grain thickness, grain diameter distribution, aspect ratio, photographic characteristics, and the like, can be arbitrarily altered. To prepare the mono-disperse emulsion of the invention any appropriate known method may be used; for example, it can be obtained by adding both aqueous silver nitrate solution and aqueous halide solution according to the double-jet method to a seed grains-containing aqueous gelatin solution under appropriate pAg and pH controls. For the adding rate of the above solutions in the double-jet precipitation process reference can be made to JP O.P.I. Nos. 48521/1979 and 49938/1983.

The silver halide grain according to the invention may also be prepared according to the method for providing silver halide grains disclosed in JP O.P.I. No. 213845/1991.

Another preferred grain according to the invention is a regular crystal grain having an average grain diameter of not more than 0.40 μm, which may be in the cubic, tetradecahedral, regular octahedral or spherical form. If the grain is a silver chloroiodobromide grain having an average grain diameter of 0.40 μm and a silver iodide content of not more than 1.0 mol %, it may be a non-tabular grain. In the case of a triggar light-sensitive material, a fine-grained silver halide having a fog speck thereinside may be mixedly used or this may be used for a lower layer underneath the layer containing the tabular grain of the invention. The lower layer underneath the layer containing the tabular grain may contain a dye-adsorbed fine-grained silver halide for crossover-cut and antihalation purposes.

The silver halide coating weight for the silver halide photographic light-sensitive material of the invention is preferably not more than 3.3 g/m$^2$ in silver equivalent per side of its support. If the coating weight exceeds 3.6 g/m$^2$, the effect of the invention becomes hardly obtainable. The number of the light-sensitive silver halide grains is preferably in the range of $2\times10^{12}$/m$^2$ to $5\times10^{15}$/m$^2$.

The above emulsion used for the photographic light-sensitive material of the invention can be prepared in accordance with any one of known methods such as, for example, the method described in Sec.1 'Emulsion Preparation and Types' of Research Disclosure RD No. 17643 (December 1978) p. 22–23; the method described in p. 648 of RD No. 18716 (November 1979); the method described in T. H. James, 'The Theory of the Photographic Process' 4th ed., Macmillan (1977) pp. 38–104; the method described in G. F. Dauffin, 'The Photographic Emulsion Chemistry,' Focal Press (1966); the method described in P. Glafkides, 'Chimie et Physique Photographique,' Paul Montel (1967); and the method described in V. L. Zelikman et al, 'Making and Coating Photographic Emulsion,' Focal Press (1964).

That is, the emulsion can be prepared under various conditions including solution conditions such as in the neutral process, acidic process and ammoniacal process; precipitation conditions such as in the normal precipitation process, reverse precipitation process, double-jet precipitation process and controlled double-jet precipitation process; grain preparation conditions such as in the conversion process and core/shell process; and combination of these conditions. An embodiment of the invention is a monodisperse emulsion comprising grains each having silver halide locally present in the inside thereof.

The emulsion may be subjected to washing treatment according to the noodle washing method or flocculation sedimentation method. Preferred examples of the washing method include the method to use a sulfo group-containing aromatic hydrocarbon aldehyde resin described in Japanese Patent Examined Publication (hereinafter abbreviated to JP E.P.) No. 16086/1960, and the method to use the exemplified coagulant polymer compounds G3 and G8 described in JP O.P.I. No. 7037/1990.

The emulsion of the invention may have various photographic additives added thereto before, during or after its physical or chemical ripening process. Known photographic additives are found in RD No. 17643 (December 1978), No. 18716 (November 1979) and No. 308119 (December 1989). The relevant sections to the photographic additives in the above three RD Numbers are as follows:

| | RD-17643 | | RD-18716 | RD-308119 | |
|---|---|---|---|---|---|
| Additives | Page | Sec. | Page Sec. | Page | Sec. |
| Chemical sensitizers | 23 | III | 648 upper right | 996 | III |

-continued

| Additives | RD-17643 Page | RD-17643 Sec. | RD-18716 Page | RD-18716 Sec. | RD-308119 Page | RD-308119 Sec. |
|---|---|---|---|---|---|---|
| Sensitizing dyes | 23 | IV | 648–649 | | 996–998 | IV |
| Desensitizing dyes | 23 | IV | | | 998 | B |
| Dyes | 25–26 | VIII | 649–650 | | 1003 | VIII |
| Development accelerators | 29 | XXI | 648 | upper right | | |
| Antifoggants, stabilizers | 24 | IV | 649 | upper right | 1006–1007 | VI |
| Brightening agents | 24 | V | | | 998 | V |
| Surfactants | 26–27 | XI | 650 | right | 1005–1006 | XI |
| Antistatic agents | 27 | XII | 650 | right | 1006–1007 | XIII |
| Plasticizers | 27 | XII | 650 | right | 1006 | XII |
| Sliding agents | 27 | XII | | | | |
| Matting agents | 28 | XVI | 650 | right | 1008–1009 | XVI |
| Binders | 26 | XXII | | | 1003–1004 | IX |
| Support materials | 28 | XVII | | | 1009 | XVII |

Useful materials for the support of the light-sensitive material of the invention include those as described in p. 28 of the above RD-17643 and in p. 1009 of RD-308119. A suitable support is, e.g., polyethylene terephthalate film, whose surface may be coated with a subbing layer or subjected to corona discharge or UV irradiation treatment in order to improve its adhesion characteristic.

Where the light-sensitive material of the invention is a medical X-ray orthochromatic film, the sensitivity of the film, when exposed through an X-ray intensifying screen comprising $Gd_2O_2S$:Tb as a fluorescent substance, is preferably in the range of ¼ time to 2 times the sensitivity of SR-H, produced by KONICA Corp., or of TMG, produced by Eastman Kodak Company, both being medical X-ray orthochromatic films of the standard speed type. Where the light-sensitive material is an ordinary medical X-ray orthochromatic both-sided emulsion film having similar characteristics, the film is preferably a light-sensitive material with a sensitivity requiring an exposure amount of not less than 0.005 lux.sec and not more than 0.050 lux.sec to obtain a density of minimum density +0.50 when exposed through an interference filter having its maximum transmittance at 545 nm and a half band width of 10 nm to a single JIS A light source provided in one direction thereto and then processed at a developing temperature of 35° C. in processing solutions XD-SR and XF-SR, produced by KONICA Corp., filled in an automatic processor SRX-502, manufactured by KONICA Corp. In addition, the crossover amount in the above film is preferably not more than 15%.

The most suitable X-ray intensifying screen for exposing the light-sensitive material of the invention is preferably one in which the filling rate of its phosphor (described in JP O.P.I. No. 21898/1991), i.e., the percentage of it accounting for of the whole phosphor layer, is not less than 70%. The protective layer of the screen is preferably of 1 to 12 μm in thickness. Preferred examples of products of this type include XG-S, available from KONICA Sales Co., and HG-M, manufactured by FUJIFILM Co.

The light emitted from the screen in the invention is preferably in the range of ¼ to 4 times as bright as the abovementioned two products.

Examples of the developing agent for use in the processing in the invention include dihydroxybenzenes such as hydroquinone; p-aminophenols such as p-aminophenol, N-methyl-p-aminophenol and 2,4-diaminophenol; and 3-pyrazolidones such as 1-phenyl-3-pyrazolidone, 1-phenyl-4-methyl-4-hydroxymethyl-3-pyrazolidone and 5,5-dimethyl-1-phenyl-3-pyrazolidone. These compounds are preferably used in combination.

The using amount of the above p-aminophenol or 3-aminopyrazolone is preferably 0.004 mol/liter and more preferably 0.04 to 0.12 mol/liter. The using amount of the above 3-aminopyrazolidone is preferably 0.001 to 0.1 mol/liter and more preferably 0.005 to 0.05 mol/liter.

The total number of moles of the dihydroxyphenol, p-aminophenol or 3-pyrazolidone contained in the whole developer solution components is preferably not more than 0.1 mol/liter.

The developer solution should be free of any aldehyde hardener such as glutaraldehyde, which is generally used for the purpose of improving processing characteristics without lowering sensitivity, because the hardener compound smells so bad as to make the working environment worse.

The developer solution may contain a preservative. Examples of the preservative include sulfites such as potassium sulfite and sodium sulfite, and reductones such as piperydinohexosereductone. These may be used in an amount of preferably 0.2 to 1 mol/liter, and more preferably 0.3 to 0.6 mol/liter. Adding a large amount of an ascorbic acid to the solution contributes to stabilization of the processing.

Examples of the alkali agent for the developer solution include pH adjusting agents such as sodium hydroxide, potassium hydroxide, sodium carbonate, sodium tertiary phosphate and potassium tertiary phosphate. Further, there may be used pH buffers such as the borates described in JP O.P.I. No. 28708/1986, and the saccharose, acetoxime, 5-sulfosalicylic acid, phosphates and carbonates described in JP O.P.I. No. 93439/1985. The amount of these chemicals to be contained in the developer solution is selected so that pH of the developer solution can be set to 9.0 to 13, preferably 10 to 12.5. And a polyethylene glycol or an ester thereof as a dissolution assistant, a quaternary ammonium salt as a sensitizer, a development accelerator, a surface active agent, and the like, may further be incorporated into the developer solution.

In addition to the above compounds, the sulfide and disulfide compounds described in JP O.P.I. Nos. 106244/1981 and 51844/1991, and the cystine and triazine compounds described in Japanese Patent Application No. 92947/1992 may be used as anti-silver-sludge agents. The developer solution may use an organic or inorganic inhibitor. Examples of the organic inhibitor include azole organic antifoggants such as indazoles, imidazoles, benzimidazoles, triazoles, benzotriazoles, tetrazoles and thiazoles. Examples of the inorganic inhibitor include sodium bromide, potassium bromide and potassium iodide. Besides, there may also be used those as described in L. F. A. Menson, the 'Photographic Processing Chemistry,' Focal Press (1966), pp. 226–229; U.S. Pat. Nos. 2,193,015 and 2,592,364; and JP O.P.I. No. 64933/1973. Suitably usable as the chelating agent for use in making city water used to prepare the developer solution free of calcium ions are the organic chelating agents having an iron-chelating stabilization constant of not less than 8 described in JP O.P.I. No. 193853/1989 and inorganic chelating agents such as sodium hexametaphosphate, calcium hexametaphosphate and polyphosphates.

The developing temperature in the invention is preferably 25° C. to 50° C., more preferably 30° C. to 40° C. The developing time is preferably 5 to 90 seconds, more preferably 8 to 60 seconds. The dry-to-dry processing time is preferably 15 to 220 seconds, and more preferably 25 to 90 seconds.

The dry-to-dry processing time is defined as the time required from the moment the leading end of the light-sensitive material to get immersed in the developer solution, through other processing steps, until the moment the same leading end comes out of the drying zone.

The replenisher in the invention comprises the same components as those of the developer solution hereinafter mentioned, and is supplied in an amount to make up for the loss due to both the processing chemicals exhaustion and the oxidation exhaustion of the developer solution.

In the processing method according to the invention, the amount of the fixer solution required for fixing the light-sensitive material is not more than 300 ml/m$^2$, the amount of the replenisher required for the fixer solution is preferably 50 ml to 300 ml/m$^2$, and more preferably 60 ml to 190 ml/m$^2$. For the replenishing method, reference can be made to the aforementioned patent.

The fixer solution used in the invention may be one which has been treated by a device for electrolytically removing silver and halide ions or one which has been recovered by having mainly its fixing agent replenished.

The fixer solution used in the invention is a solution containing a thiosulfate that is commonly used for fixer solutions, and its pH is 3.8 or more, preferably 4.2 to 5.5. The fixing agent is a thiosulfate such as ammonium thiosulfate or sodium thiosulfate, and most preferably ammonium thiosulfate from the fixing rate point of view.

The water-soluble aluminum salt that reacts mainly as a hardening agent in the fixer solution is a compound generally known as the hardening agent for acid hardening fixer baths. Besides, there are, for example, aluminum chloride and potassium alum. The aluminum ion of these hardeners becomes precipitating in the form of aluminum hydroxide to thereby lower the fixing capacity of a fixer bath, so that in the case of a fixer solution as in the low-replenishment-rate fixing of the invention it is preferable to remove the ion, and if the use of a fixer containing the aluminum ion is essential, its pH should not exceed 5.0.

The fixer solution may, if necessary, contain a preservative such as a sulfite or hydrogensulfite; a buffer such as acetic acid, nitric acid or boric acid; a pH adjusting agent such as sulfuric acid, sodium hydroxide, etc.; and a chelating agent as a water softener. The fixer solution may contain surface active agents including an anionic surfactant such as a sulfuric acid ester or a sulfonate compound; a nonionic surfactant such as a polyethylene-glycol compound or a ester compound; and the amphoteric surfactant described in JP O.P.I. No. 6840/1982. It may also contain a wetting agent such as alkanolamine or alkylene glycol.

As the fixation accelerator there may be used the thiourea derivatives described in JP E.P. Nos. 35754/1970, 122535/1983 and 122536/1983 or the thioether described in U.S. Pat. No. 4,126,459.

In the invention, the replenisher to the fixer solution and that to the developer solution have their respective compositions identical with those of the fixer solution and the developer solution, respectively. In the automatic processor of the invention, the ratio of the replenishing amount to the developer bath:the replenishing amount to the fixer bath per unit area of the light-sensitive material to be processed is preferably in the range of 1:1.5 to 1:0.7, and more preferably 1:1.2 to 1:0.9. The automatic processor's developer bath-:fixer bath capacity ratio range is preferably the same as the above replenishing amount ratio range.

EXAMPLES

The invention is illustrated further in detail by the following examples, but the invention is not limited to and by the examples.

EXAMPLE 1

Preparation of Silver Chlorobromide Emulsion

In the presence of iridium(III) chloride in an amount of $5.0\times10^{-7}$ mol per mol of silver, to an aqueous gelatin solution kept at pH 3.0 and 38° C. were added an aqueous silver nitrate solution and an aqueous potassium chloride/potassium bromide solution according to a double-jet precipitation process spending 60 minutes, during which the reaction system's pH and pAg were controlled to 5.8 and 7.0, respectively. After completion of the addition, pH was adjusted to 6.0, and 3,3'-diethyl-5-methoxy- 9,11-neoprntylenethiatricarbocyanine-iodide as an infrared-sensitizing dye in an amount of 500 mg/mol of AgX was added, and further, at 40° C., an aqueous solution of Demol N, produced by Kao Atlas Co., was used to desalt the emulsion. After that, an aqueous gelatin solution was added thereto for redispersion, whereby a silver chlorobromide emulsion containing silver bromide/silver chloride in proportion of 95:15 mol % was prepared. The obtained emulsion is a cubic grains monodisperse emulsion having an average grain diameter of 0.37 μm, which was designated as Emulsion I-1.

A silver chloroiodobromide emulsion containing 1.2 mol % silver iodide was prepared under the same conditions as in the above Emulsion I-1 except that a solution of potassium iodide/potassium bromide in a molar ratio of 1.26:98.74 prepared by adding potassium iodide to the aqueous potassium bromide solution was used in place of the potassium bromide solution.

The obtained emulsion was of monodisperse cubic grains having an average grain diameter of 0.36 μm and a variation coefficient of 11%, and the emulsion was designated as Emulsion I-2.

Further, Emulsions II-1 and II-2 were prepared under the same conditions as in the above Emulsions I-1 and I-2, respectively, except that the temperature and pH were controlled to 42° C. and 3.2, respectively. The obtained Emulsion II-1 was of cubic monodisperse grains having an average grain diameter of 0.45 μm and a variation coefficient of 12%, while Emulsion II-2 was of cubic monodisperse grains having an average grain diameter of 0.43 μm and a variation coefficient of 13%.

Subsequently, to each emulsion were added the following additives in the following amounts per mol of silver halide to thereby prepare its emulsion coating solution.

| | |
|---|---|
| Nitrophenyltriphenylphosphonium chloride | 30 mg |
| Ammonium 1,3-dihydroxybenzene-4-sulfonate | 1 g |
| 2-mercaptobenzothiazole | 10 mg |
| Trimethylolpropane | 9 g |
| 1,1-dimethylol-1-bromo-1-nitromethane | 10 mg |
| $C_4H_9OCH_2CH(OH)CH_2N(CH_2COOH)_2$ | 1 g |
| 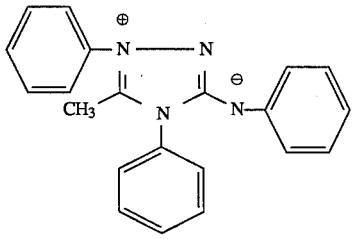 | 60 mg |
| 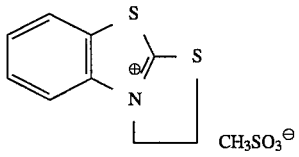 | 35 mg |

Each of the above emulsions was coated along with a protective layer in the simultaneous double-layer slide hopper coating manner on one subbed side of a backing-coated support, said backing layer being prepared with glyoxal and 2 g/m$^2$ of a dye-emulsified dispersion consisting of 400 g of gelatin, 2 g of a polymethacrylate having an average particle size of 6 μm, 24 g of potassium nitrate, 6 g of sodium dodecylbenzenesulfonate and 120 g of the following antihalation dye, said support being a polyethylene terephthalate base coated with a subbing layer consisting of a copolymer aqueous dispersion obtained by diluting a glycidyl methacrylate-methyl acrylate-butyl methacrylate copolymer (ratio by weight: 50:10:40) to make its concentration 10%, said protective layer containing gelatin, a matting agent, glyoxal and sodium dodecylbenzenesulfonate.

In addition, Samples No. 35 and No. 36 were prepared in the same manner as in the above and other samples listed in Tables 1 and 2 except that the emulsion and protective layers were coated so as to have the following coating weights:

Sample No. 35 . . . emulsion: 3.0 g/m$^2$ in silver equivalent gelatin for emulsion layer: 2.4 g/m$^2$ gelatin for protective layer: 1.1 g/m$^2$.

Sample No. 36 . . . emulsion: 3.65 g/m$^2$ in silver equivalent gelatin for emulsion layer: 2.4 g/m$^2$ gelatin for protective layer: 1.18 g/m$^2$.

Antihalation dye-1

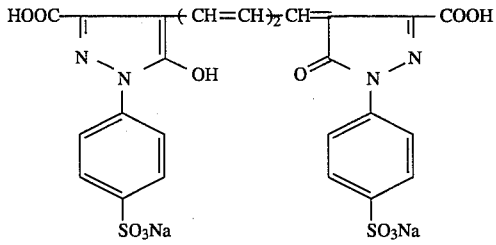

Procedure to Find Residual Color and Fog Values

Of the obtained film samples the silver chlorobromide emulsion film samples were cut into 2000 10×12-size pieces, the film pieces were each exposed so as to have a density of 1.0 and then subjected to running processing in the following developer solution, and this used developer solution was reserved for the following step: The samples that were prepared in Example 1 were each exposed through a wedge to a laser light having a wavelength of 633 nm and then processed in the above used developer solution under the conditions given in the following tables.

Unexposed samples also were processed likewise, and from these processed samples the residual color stain appearance thereof was rated in accordance with the following evaluation criteria:

Evaluation Criteria

5: No residual color stain.

4: A slight residual color stain.

3: A little residual color stain, but acceptable for practical use.

2: A fairly discernible residual color stain, but barely allowed for practical use.

1: A conspicuous residual color stain, unacceptable for practical use.

The processing was made in a developer solution free of glutaraldehyde and a fixer solution excluding aluminum sulfate according to the following prescriptions.

Each sample was developed at 35° C., fixed at 33° C., washed at 18° C. with wash water flow rate of 3.5 liters per minute, and dried at 45° C. The overall processing steps made progress at speeds specified in the tables, in which the developer was replenished in an amount of 160 ml/m$^2$, while the fixer bath was replenished as shown in the tables. In addition, a starter was used at the time of starting the running processing.

| Developer composition | |
|---|---|
| Potassium sulfite | 70 g |
| Trisodium hydroxyethylethylenediamine-triacetate | 8 g |
| 1,4-Dihydroxybenzene | 28 g |
| Boric acid | 10 g |
| 5-methylbenzotirazole | 0.04 g |
| 1-Phenyl-5-mercaptotetrazole | 0.01 g |
| Sodium metabisulfite | 5 g |
| Acetic acid (90%) | 13 g |
| Triethylene glycol | 15 g |
| 1-Phenyl-3-pyrazolidone | 1.2 g |
| 5-Nitroindazole | 0.2 g |
| Potassium bromide | 4 g |
| 5-Nitrobenzimidazole | 1 g |
| Water to make 1 liter. | |
| Adjust pH to 10.5 with use of sodium hydroxide. | |
| **Starter composition** | |
| Potassium bromide | 300 g |
| Glacial acetic acid | 144 g |
| Water to make 1 liter. | |
| Adjust pH to 4.2 with use of glacial acetic acid. | |
| **Fixer bath composition** | |
| Sodium thiosulfate, pentahydrate | 4.5 g |
| Disodium ethylenediaminetetraacetate | 0.5 g |
| Ammonium thiosulfate | 150 g |
| Anhydrous sodium sulfite | 8 g |
| Potassium acetate | 16 g |
| Sulfuric acid (50% by weight) | 5 g |
| Citric acid | 1 g |
| Boric acid | 7 g |
| Glacial acetic acid | 5 g |

-continued

| | |
|---|---|
| Water to make 1 liter. | |
| Adjust pH to 4.8 with use of glacial acetic acid. | |

The obtained fog values and residual color stain evaluation results are shown in Tables 1 and 2.

TABLE 1

| Sample No. | Em No. | AgI content (mol %) | Average grain thickness (μm) | $H_D$ (m) | $H_1$ (m) | $H_2$ (m) | T (sec) | Auto-processor | H XT = 0.75 (sec) | Fixer repl. amt. (ml/m$^2$) | Fog | Residual color stain |
|---|---|---|---|---|---|---|---|---|---|---|---|---|
| 1 (Comp.) | I-1 | 0 | 0.37 | 1.00 | 0.53 | 0.47 | 20.0 | A | 20.0 | 333 | 0.02 | 3 |
| 2 (Comp.) | I-2 | 1.2 | 0.36 | " | " | " | " | " | " | " | 0.02 | 2 |
| 2 (Comp.) | I-2 | 1.2 | 0.36 | " | " | " | " | " | " | " | 0.02 | 2 |
| 3 (Comp.) | II-1 | 0 | 0.45 | " | " | " | " | " | " | " | 0.02 | 2 |
| 4 (Comp.) | II-2 | 1.2 | 0.43 | " | " | " | " | " | " | " | 0.02 | 1 |
| 5 (Inv.) | I-1 | 0 | 0.37 | " | 0.47 | 0.53 | " | B | " | " | 0.01 | 5 |
| 6 (Comp.) | I-2 | 1.2 | 0.36 | " | " | " | " | " | " | " | 0.02 | 3 |
| 7 (Comp.) | II-1 | 0 | 0.45 | " | " | " | " | " | " | " | 0.02 | 3 |
| 8 (Comp.) | II-2 | 1.2 | 0.43 | " | " | " | " | " | " | " | 0.02 | 2 |
| 9 (Inv.) | I-1 | 0 | 0.37 | " | 0.40 | 0.60 | " | C | 0.41 | " | 0.01 | 5 |
| 10 (Comp.) | I-2 | 1.2 | 0.36 | " | " | " | " | " | " | " | 0.02 | 3 |
| 11 (Comp.) | II-1 | 0 | 0.45 | " | " | " | " | " | " | " | 0.01 | 3 |
| 12 (Comp.) | II-2 | 1.2 | 0.43 | " | " | " | " | " | " | " | 0.02 | 2 |
| 13 (Comp.) | I-1 | 0 | 0.37 | " | 0.53 | 0.47 | 24.0 | A | 24.0 | " | 0.02 | 4 |
| 14 (Comp.) | I-2 | 1.2 | 0.36 | " | " | " | " | " | " | " | 0.02 | 4 |
| 15 (Comp.) | II-1 | 0 | 0.45 | " | " | " | " | " | " | " | 0.02 | 4 |
| 16 (Comp.) | II-2 | 1.2 | 0.43 | " | " | " | " | " | " | " | 0.02 | 3 |
| 17 (Inv.) | I-1 | 0 | 0.37 | " | 0.40 | 0.60 | 10.0 | C | 10.0 | " | 0.02 | 4 |
| 18 (Comp.) | I-2 | 1.2 | 0.36 | " | " | " | " | " | " | " | 0.02 | 1 |
| 19 (Comp.) | II-1 | 0 | 0.45 | " | " | " | " | " | " | " | 0.02 | 2 |
| 20 (Comp.) | II-2 | 1.2 | 0.43 | " | " | " | " | " | " | " | 0.02 | 1 |
| 21 (Comp.) | I-1 | 0 | 0.37 | " | 0.53 | 0.47 | 20.0 | A | 20.0 | 275 | 0.02 | 2 |
| 22 (Comp.) | I-2 | 1.2 | 0.36 | " | " | " | " | " | " | " | 0.02 | 1 |
| 23 (Comp.) | II-1 | 0 | 0.45 | " | " | " | " | " | " | " | 0.02 | 2 |
| 24 (Comp.) | II-2 | 1.2 | 0.43 | " | " | " | " | " | " | " | 0.02 | 1 |

TABLE 2

| Sample No. | Em No. | AgI content (mol %) | Average grain thickness (μm) | $H_D$ (m) | $H_1$ (m) | $H_2$ (m) | T (sec) | Auto-processor | H XT = 0.75 (sec) | Fixer repl. amt. (ml/m$^2$) | Fog | Residual color stain |
|---|---|---|---|---|---|---|---|---|---|---|---|---|
| 25 Inv. | I-1 | 0 | 0.37 | 1.00 | 0.40 | 0.60 | 20.0 | C | 20.0 | 275 | 0.01 | 5 |
| 26 (Comp.) | I-2 | 1.2 | 0.36 | " | " | " | " | " | " | " | 0.02 | 2 |
| 27 (Comp.) | II-1 | 0 | 0.45 | " | " | " | " | " | " | " | 0.02 | 2 |
| 28 (Comp.) | II-2 | 1.2 | 0.43 | " | " | " | " | " | " | " | 0.02 | 1 |
| 29 (Inv.) | I-1 | 0 | 0.37 | 0.50 | 0.23 | 0.27 | 18.0 | E | 10.7 | " | 0.02 | 4 |
| 30 (Comp.) | I-2 | 1.2 | 0.37 | " | " | " | " | " | " | " | 0.02 | 2 |
| 31 (Comp.) | I-2 | 1.2 | 0.37 | " | " | " | 38.0 | " | 22.6 | " | 0.02 | 4 |
| 32 (Comp.) | I-1 | 0 | 0.37 | " | 0.27 | 0.23 | 18.0 | D | 10.7 | " | 0.01 | 2 |
| 33 (Comp.) | I-1 | 0 | 0.37 | 1.00 | 0.40 | 0.60 | 8.0 | C | 8.0 | 333 | 0.02 | 3 |
| 34 (Comp.) | I-1 | 0 | 0.37 | 0.50 | 0.23 | 0.27 | 14.0 | E | 8.3 | " | 0.02 | 2 |
| 35 (Inv.) | I-1 | 0 | 0.37 | 1.00 | 0.40 | 0.60 | 20.0 | C | 20.0 | " | 0.01 | 4 |
| 36 (Inv.) | I-1 | 0 | 0.37 | " | 0.40 | 0.60 | " | " | " | 195 | 0.01 | 3 |

As is apparent from Tables 1 and 2, the invention makes it possible to obtain a silver halide photographic light-sensitive material capable of providing a clear image free of fog and residual color stain.

EXAMPLE 2

Preparation of Silver Iodobromide Emulsion

Preparation of Seed Emulsion Em-O

A hexagonal tabular seed grain emulsion was prepared in the following manner:

-continued

| | |
|---|---|
| succinate (10% ethanol solution) | |
| Potassium bromide | 26.8 g |
| 10% sulfuric acid | 144 ml |
| Solution B | |
| 2.5 N silver nitrate aqueous solution | 3500 ml |
| Solution C | |
| Potassium bromide | 1029 g |
| Potassium iodide | 29.3 g |

Solution A

| | |
|---|---|
| Osein gelatin | 60.2 g |
| Distilled water | 20000 ml |
| Sodium polyisopropylene-polyethyleneoxy- | 5.6 ml |

-continued

| | |
|---|---|
| Distilled water to make 3500 ml. | |
| Solution D | |
| 1.75 N KBr aqueous solution | Amount necessary for the following potential control |

A mixer/stirrer of the type described in JP E.P. Nos. 58288/1983 and 58289/1983 was used to add 64.1 ml each of Solutions B and C to Solution A, spending 2 minutes, according to a double-jet precipitation process, whereby the seed grain speck formation was carried out.

After suspending the addition of Solutions B and C, the temperature of Solution A was raised, spending 60 minutes, up to 60° C., and then Solutions B and C, each at a flow rate of 68.5 ml/min, were again added, spending 50 minutes, to the Solution A according to the double-jet process. During the time of the addition, the silver potential (measured with a silver ion selection electrode with a comparative saturated silver-silver chloride electrode) was controlled to +6 mV with use of Solution D.

After completion of the addition, pH was adjusted to 6 with use of a 3% KOH solution, and immediately desalting took place. The obtained emulsion was designated as Seed Emulsion Em-O. This emulsion was electron-microscopically found to be of silver halide grains 90% or more of the whole projection image area of which are comprised of hexagonal tabular crystal grains having the maximum aspect ratio of 1.0 to 2.0, an average thickness of 0.07 μm, and an average grain diameter (of a circle equivalent) of 0.5 μm.

Preparation of Tabular Grain Emulsion

The following four different solutions were used to prepare a silver iodobromide tabular grain emulsion Em-1 containing 1.20 mol % AgI.

| | |
|---|---|
| Solution A | |
| Ossein gelatin | 29.4 g |
| Seed Emulsion Em-O equivalent to | 1.6 mol |
| Sodium polyisopropylene-polyethyleneoxy-disuccinate (10% ethanol solution) | 3.0 ml |
| Distilled water to make 1400 ml. | |
| Solution B | |
| 3.5 N silver nitrate solution | 2360 ml |
| Solution C | |
| Potassium bromide | 970 g |
| Potassium iodide | 22.8 g |
| Distilled water to make 2360 ml. | |
| Solution D | |
| 1.75 N KBr aqueous solution | amount necessary for silver potential control |

The grain growth from the seed emulsion was carried out in the manner that at 60° C. the total quantities of Solutions B and C were added at a flow rate of 21.26 ml/min, spending 111 minutes, to Solution A by using a mixer/stirrer of the type described in JP E.P. Nos. 58288/1983 and 58289/1983 according to the double-jet precipitation process.

During the grain growth process the silver potential was controlled by use of Solution D to +28 mV. After completion of the addition, the following spectral sensitizing dye A in an amount of 300 mg/mol AgX and dye B in an amount of 15 mg/mol AgX.

Next, in order to remove the excessive salts, both an aqueous solution of Demol N, produced by Kao Atlas Co., and an aqueous magnesium sulfate solution were used to subject the emulsion to precipitation desalting treatment, and then an aqueous gelatin solution containing 92.2 g of osein gelatin was added and stirred the emulsion to make its dispersion.

Approximately 3000 silver halide grains of Emulsion Em-1 were electron-microscopically observed to analyze their forms, and the results thereof are shown in Table 3.

Sensitizing dye A: Anhydride of sodium 5,5'-dichloro-9-ethyl- 3,3'-di-(3-sulfopropyl)oxacarbocyanine.

Sensitizing dye B: Anhydride of sodium 5,5'-di-(butoxycarbonyl)-1,1'-diethyl- 3,3'-di-(4-sulfobutyl)benzimidazolocarbocyanine.

Tabular silver iodobromide Emulsion Em-2 was prepared in the same manner as in Em-1 except that the AgI content thereof was changed to 0.84 mol % by reducing the KI content of the Solution C in the preparation of Em-1 to 70%. In the same manner as in Em-1, about 3000 grains of Em-2 were electron-microscopically examined to analyze their forms, and the results are also shown in Table 3.

Different tabular silver iodobromide Emulsions Em-3 and Em-4 were prepared in the same manner as in Em-1 and Em-2, respectively, except that the silver potential was controlled to [ml]P'mV by use of Solution D. The results of the electron-microscopic analysis of their grain forms are shown in Table 3.

To each of these emulsions were added the additives in the amounts as designated in from the 16th line of p. 95 to the 20th line of p. 96 of JP O.P.I. No. 301774/1990 and the following Ludox AM in an amount of 10 g per mol of silver halide. Further, 1.2 g of an emulsified dispersion of the following dye were added to each emulsion to make each emulsion coating solution.

Preparation of Dye Emulsified Dispersion

Ten kilograms of the following dye were dissolved at 55° C. in a solvent composed of 28 liters of tricresyl phosphate and 85 liters of ethyl acetate; this is called an oily solvent. On the other hand, an aqueous 9.3% gelatin solution containing 1.35 kg of an anionic surface active agent (AS) was prepared; this is called an aqueous solvent.

Next, in a dispersing kettle, the oily solvent and the aqueous solvent were dispersed at a temperature controlled to 40° C.

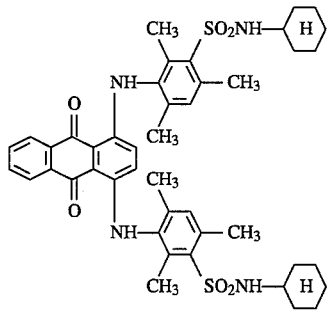

(Dye)

-continued

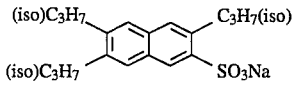

(AS)

The additives that were used for the protective layer are as follows, in which the added amounts are values per liter of the coating solution.

| Protective layer coating solution | |
|---|---|
| Lime-treated inert gelatin | 68 g |
| Acid-treated gelatin | 2 g |
| Sodium i-amyl-n-decylsulfosuccinate | 0.3 g |
| Polymethyl methacrylate, matting agent having an area average particle size of 5.0 μm | 1.1 g |
| Silicon dioxide particles, matting agent having an area average particle size of 3.0 μm | 0.5 g |
| Ludox AM, colloidal silica, produced by DuPont | 30 g |
| Aqueous 40% glyoxal solution, hardener | 1.5 ml |
| $(CH_2{=}CHSO_2CH_2)_2O$, hardener | 500 mg |
| HCHO | 150 mg |

-continued

| Protective layer coating solution | |
|---|---|
| $C_{12}H_{25}CONH(CH_2CH_2O)_5H$ | 2.0 g |

A 175 μm-thick polyethylene terephthalate base with its both side surfaces subcoated with a copolymer aqueous dispersion obtained by diluting glycidyl methacrylate-methyl methacrylate-butyl methacrylate copolymer (50:10:40 wt %) so as to make its concentration 10% by weight was used and on both sides of it were coated simultaneously emulsion layers and protective layers at a coating speed of 90 meters per minute so that the coated weight per side of the support of the emulsion layer was 1.7 g/m$^2$ in silver equivalent, that of gelatin was 2.5 g/m$^2$ and the gelatin-coated weight of the protective layer was 0.99 g/m$^2$ by means of two slide hopper-type coater units, and then the coated film was dried in 2 minutes and 15 seconds.

The residual color stain evaluation and fog values were found in the same manner as in Example 1. The results are shown in Table 3.

TABLE 3

| Sample No. | Emulsion used | Average grain thickness (μm) | d/h | Distribution broadness (%) | AgI content (mol %) | $H_D$ (m) | $H_1$ (m) | $H_2$ (m) | T (sec) | Auto-processor | H XT = 0.75 (sec) | Fixer repl. amt (ml/m$^2$) | Fog | Residual color stain |
|---|---|---|---|---|---|---|---|---|---|---|---|---|---|---|
| 2-1 (Comp.) | Em-1 | 0.36 | 4.4 | 12 | 1.20 | 1.00 | 0.53 | 0.47 | 20.0 | A | 20.0 | 350 | 0.02 | 3 |
| 2-2 (Comp.) | Em-2 | 0.35 | 4.5 | 13 | 0.84 | " | " | " | " | " | " | " | 0.02 | 3 |
| 2-3 (Comp.) | Em-3 | 0.45 | 3.6 | 11 | 1.20 | " | " | " | " | " | " | " | 0.02 | 3 |
| 2-4 (Comp.) | Em-4 | 0.44 | 3.7 | 12 | 0.84 | " | " | " | " | " | " | " | 0.02 | 3 |
| 2-5 (Comp.) | Em-1 | 0.36 | 4.4 | 12 | 1.20 | " | 0.40 | 0.60 | 20.0 | C | 20.0 | " | 0.01 | 3 |
| 2-6 (Inv.) | Em-2 | 0.35 | 4.5 | 13 | 0.84 | " | " | " | " | " | " | " | 0.02 | 5 |
| 2-7 (Comp.) | Em-3 | 0.45 | 3.6 | 11 | 1.20 | " | " | " | " | " | " | " | 0.02 | 3 |
| 2-8 (Comp.) | Em-4 | 0.44 | 3.7 | 12 | 0.84 | " | " | " | " | " | " | " | 0.02 | 3 |
| 2-9 (Comp.) | Em-1 | 0.36 | 4.4 | 12 | 1.20 | 1.00 | 0.40 | 0.60 | " | C | 10.0 | 214 | 0.01 | 2 |
| 2-10 (Inv.) | Em-2 | 0.35 | 4.5 | 13 | 0.84 | " | " | " | " | " | " | " | 0.02 | 4 |
| 2-11 (Comp.) | Em-3 | 0.45 | 3.6 | 11 | 1.20 | " | " | " | " | " | " | " | 0.01 | 1 |
| 2-12 (Comp.) | Em-4 | 0.44 | 3.7 | 12 | 0.84 | " | " | " | " | " | " | " | 0.02 | 2 |
| 2-13 (Comp.) | Em-1 | 0.36 | 4.4 | 12 | 1.20 | 0.50 | 0.27 | 0.23 | 20.0 | D | 11.9 | 360 | 0.02 | 2 |
| 2-14 (Comp.) | Em-2 | 0.35 | 4.5 | 13 | 0.84 | " | " | " | " | " | " | " | 0.02 | 2 |
| 2-15 (Comp.) | Em-3 | 0.45 | 3.6 | 11 | 1.20 | " | " | " | " | " | " | " | 0.02 | 1 |
| 2-16 (Comp.) | Em-4 | 0.44 | 3.7 | 12 | 0.84 | " | " | " | " | " | " | " | 0.02 | 1 |
| 2-17 (Comp.) | Em-1 | 0.36 | 4.4 | 12 | 1.20 | " | 0.23 | 0.27 | " | E | " | " | 0.02 | 2 |
| 2-18 (Comp.) | Em-2 | 0.35 | 4.5 | 13 | 0.84 | " | " | " | " | " | " | " | 0.02 | 4 |
| 2-19 (Comp.) | Em-3 | 0.45 | 3.6 | 11 | 1.20 | " | " | " | " | " | " | " | 0.02 | 2 |
| 2-20 (Comp.) | Em-4 | 0.44 | 3.7 | 12 | 0.84 | " | " | " | " | " | " | " | 0.02 | 2 |

-continued

| Protective layer coating solution | |
|---|---|
| 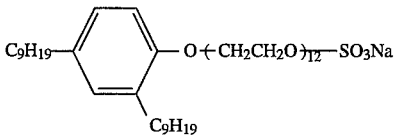 | 1.0 mg |
| 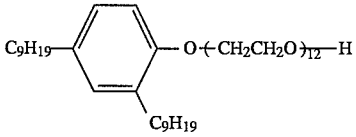 | 0.4 mg |
| $NaO_3S{-}CH(CH_2COOCH_2(C_2F_4)_3H)COOCH_2(C_2F_4)_3H$ | 0.5 mg |

It is apparent from Table 3 that the silver halide photographic light-sensitive material can provide a good image having little or no fog and little or no residual color stain even when subjected to the rapid processing having a value according to Formula 1 of not more than 21.0 by being processed in an automatic processor under developing conditions comprising a roller transport system corresponding to Formula 1.

The method of the invention can exhibit its effect sufficiently even in the case where the replenishing amount to the fixer solution is reduced, so that it is very useful for a low-replenishment-rate rapid processing.

What is claimed is:

1. A method for processing an exposed silver halide photographic light-sensitive material using a roller transport automatic processing machine having a developing tank containing a developing solution, a fixing tank containing a fixing solution, a washing tank containing a washing solution and a drying means, comprising the steps of:

developing the exposed silver halide photographic light-sensitive material, fixing the developed material, washing the fixed material, and drying the washed material, wherein said method is carried out under the following condition:

$$9.0 \leqq H_D^{0.75} \times T \leqq 21.0,\ H_D = H_1 + H_2,\ H_1 \leqq H_2,$$

wherein $H_D$ represents transport line length, in meters, from the material entry point into the developer solution to the material entry point into the washing solution, $H_1$ represents transport line length, in meters, from the material entry point into the developer solution to the material entry point into the fixing solution, $H_2$ represents transport line length, in meters, from the material entry point into the fixing solution to the material entry point into the washing solution, and T represents in terms of seconds the time necessary for transporting the material from the material entry point into the developing solution to the material entry point into the washing solution, and said material comprises a silver halide photographic emulsion comprising silver iodobromide containing an average silver iodide content of not more than 1.0 mol % or silver chloroiodobromide grains containing an average silver iodide content of not more than 1.0 mol % wherein at least 50% of the whole projection area of the silver iodobromide or the silver chloroiodobromide grains have an average grain thickness of not more than 0.40 μm.

2. The method of claim 1, wherein a replenishing amount to the fixing solution per $m^2$ of said material, is not more than 300 ml.

3. The method of claim 1, wherein a replenishing amount to the fixing solution per $m^2$ of said material, is within the range of 60 to 190 ml.

4. The method of claim 1, wherein said material comprises a silver halide photographic emulsion comprising silver iodobromide containing an average silver iodide content of from 0.1 to 0.8 mol % or silver chloroiodobromide grains containing an average silver iodide content of from 0.1 to 0.8 mol %.

5. The method of claim 1, wherein said silver chloroiodobromide grains contain an average silver chloride content of 0 to 20 mol %.

6. The method of claim 1, wherein said silver chloroiodobromide grains contain an average silver chloride content of from 0 to 12 mol %.

7. The method of claim 1, wherein at least 70% of the whole projection area of the silver iodobromide or the silver chloroiodobromide grains have an average grain thickness of not more than 0.40 μm.

8. The method of claim 1, wherein said silver halide photographic light-sensitive material comprises a support and has on at least one side thereof a silver halide emulsion layer and a silver halide coating weight on said side is not more than 3.3 $g/m^2$.

9. The method of claim 1, wherein said silver halide photographic emulsion comprises tabular grains having an average aspect ratio of not less than 2.

10. The method of claim 1, wherein said silver halide photographic emulsion comprises tabular grains having an average aspect ratio of 2 to 30.

11. The method of claim 1, wherein said average grain thickness is within the range of 0.05 to 0.25 μm.

12. The method of claim 1, wherein a time required from a moment the leading end of said light-sensitive material begins to get immersed in said developer solution, through said fixing solution and said washing solution, until a moment the leading end comes out of a drying zone, is within the range of 15 to 220 seconds.

13. The method of claim 1, wherein a time required from a moment the leading end of said light-sensitive material begins to get immersed in said developer solution, through said fixing solution and said washing solution, until a moment the leading end comes out of a drying zone, is within the range of 25 to 90 seconds.

14. The method of claim 1, wherein the temperature of the developing solution during said developing is within the range of 25° to 50° C.

15. The method of claim 1, wherein the temperature of the developing solution during said developing is within the range of 30° to 40° C.

16. The method of claim 1, wherein a time of said developing is within the range of 5 to 90 seconds.

17. The method of claim 1, wherein a time of said developing is within the range of 8 to 60 seconds.

* * * * *